US005194839A

United States Patent [19]

Tanaka

[11] Patent Number: 5,194,839

[45] Date of Patent: Mar. 16, 1993

[54] ELECTROMAGNETIC RELAY ASSEMBLY WITH TEST ACTUATOR

[75] Inventor: Katsumi Tanaka, Yamaga, Japan

[73] Assignee: Omron Corporation, Kyoto, Japan

[21] Appl. No.: 886,244

[22] Filed: May 21, 1992

[30] Foreign Application Priority Data

May 21, 1991 [JP] Japan ..... 3-35809[U]

[51] Int. Cl.[5] ..... H01H 51/22

[52] U.S. Cl. ..... 335/78; 335/202; 335/128

[58] Field of Search ..... 335/78-86, 335/104, 121, 124, 128, 130-133, 202

[56] References Cited

U.S. PATENT DOCUMENTS

| | | | |
|---|---|---|---|
| 4,322,702 | 3/1982 | Bosch | 335/202 |
| 4,400,672 | 8/1983 | Bottelson | 335/202 |
| 4,405,911 | 9/1983 | Hasegawa et al. | 335/202 |
| 4,542,359 | 9/1985 | Ide et al. | 335/78 |
| 5,027,094 | 6/1991 | Yasuoka et al. | 335/83 |

FOREIGN PATENT DOCUMENTS

| | | |
|---|---|---|
| 56-75434 | 6/1981 | Japan . |
| 56-140127 | 1/1983 | Japan . |
| 58-75239 | 5/1983 | Japan . |
| 58-7448 | 11/1983 | Japan . |
| 58-191032 | 11/1983 | Japan . |
| 60-59335 | 4/1985 | Japan . |
| 60-186644 | 9/1985 | Japan . |
| 60-263222 | 12/1985 | Japan . |
| 62-222321 | 9/1987 | Japan . |
| 63-39743 | 2/1988 | Japan . |

*Primary Examiner*—Lincoln Donovan
*Attorney, Agent, or Firm*—Foley & Lardner

[57] ABSTRACT

An electromagnetic relay assembly which comprises a relay unit having a generally elongated contact carrier member supported for pivotal movement about a point of pivot and normally biased in one direction, and a casing enclosing the relay unit and including at least first and second wall members angled relative to each other. The casing has a corner opening defined at a corner region between top and side walls and delimited by a first open area in the top wall and a second open area in the side wall. The corner opening in the casing is closed by a covering with the first and second lids covering the first and second open areas, respectively. The side wall has opposite side edges confronting the side open area, and respective portions of the side edges adjacent the top wall are formed with guide members for slidably receiving the second lid when the covering is mounted on the casing. A test actuator element is secured to the second lid for driving the contact carrier member in an opposite direction when an external pushing force is applied to the second lid and also for driving the contact carrier member in the opposite direction when the second lid is further slid by an application of an external pushing force to the first lid.

4 Claims, 2 Drawing Sheets

ELECTROMAGNETIC RELAY ASSEMBLY WITH TEST ACTUATOR

BACKGROUND OF THE INVENTION

1. Field of the Invention

The present invention generally relates to electric relay assemblies and, more particularly, to electromagnetic relay assemblies of a type having a test actuator for actuating the electromagnetic relay assembly to ascertain the operability thereof.

2. Description of the Prior Art

Electromagnetic relay assemblies of the type referred to above are well known in the art. The test actuator is generally used to ascertain the operability of the associated electromagnetic relay assembly, that is, to ascertain whether or not the associated electromagnetic relay assembly functions properly.

Two examples of prior art electromagnetic relay assemblies of the type referred to above are shown in side sectional and partially sectioned side views in FIGS. 3 and 4 of the accompanying drawings, respectively, reference to which will now be made for further discussion of the prior art.

The electromagnetic relay assembly shown in FIG. 3 comprises a generally rectangular or square base 1 including a generally L-shaped yoke 2 rigidly mounted thereon. The L-shaped yoke 2 has an upright portion 2*a*, secured at one end to the base 1, and an overhang portion 2*b* continued at one end to the opposite end of the upright portion 2*a* so as to extend perpendicular to the upright portion 2*a* and generally parallel to the base 1. An armature or electromagnet 3 having a core and a winding formed around the core has opposite poles and is secured at one of the poles rigidly to the upright portion 2*a* of the L-shaped yoke 2.

The illustrated relay assembly also comprises a movable iron bar 4 having one end pivotably connected to a free end of the overhang portion 2*b* of the L-shaped yoke 2, the opposite end of which is integrated together with a generally elongated movable contact member 6 by means of a retainer 5. The contact member 6 has one end remote from the retainer 5 formed with a movable contact element 6*a* selectively engageable with one of two fixed contact elements 7*a* and 7*b* that are mounted stationarily on the base 1. So far illustrated, the movable iron bar 4 together with the contact member 6 is normally biased so as to permit the movable contact element 6*a* to engage the fixed contact element 7*a*, such that when the armature 3 is electrically energized, the movable iron bat 4 can be magnetically attracted towards the adjacent pole of the armature 3 with the movable contact element 6*a* consequently switched from the fixed contact element 7*a* to the fixed contact element 7*b*.

While the above described assembly is encased in a generally cubic casing 9, the test actuator employed in the prior art relay assembly shown in FIG. 3 comprises a push rod 9 having an inner end operatively coupled with the retainer 5 and an outer end slidably extending through an opening 9*a* defined in a top wall of the casing 9. Therefore, when an external pushing force is applied to the outer end of the push rod 9, the applied push is transmitted to the retainer 5 causing the movable iron bar 4 to pivot counterclockwise as viewed in FIG. 3 about a point 4*a* of pivot with the movable contact element 6*a* consequently brought into engagement with the fixed contact element 7*b*. Whether or not the illustrated relay assembly does function properly can be ascertained in any known method, for example, by means of a testing instrument that may be connected electrically with the fixed contact elements 7*a* and 7*b*.

In the prior art electromagnetic relay assembly shown in FIG. 4, the test actuator comprises a headed push rod 8*b* having a head formed at the inner end thereof and held in contact with the retainer 5 while the outer end thereof extends axially slidably through an opening 9*b* that is defined in one of side walls forming the casing 9.

The relay assembly shown in FIG. 4 functions in a manner substantially similar to that shown in FIG. 3, except for a difference found in direction from which the external pushing force is applied to the push rod.

However, it has been found that any one of the prior art electromagnetic relay assemblies shown in and described with reference to FIGS. 3 and 4, respectively, is difficult to assembly to a final shape, involving a time-consuming and laborious effort which eventually results in not only an increase in manufacturing cost, but also a difficulty for the relay assembly to be assembled on an automated production line.

More specifically, the relay unit including the yoke carrying the movable electric contact member and the armature all in assembled state on the base is, after they have been assembled together, encased in the casing 9. The employment of the push rod forming a part of the test actuator and being a member separate and independent from the relay unit requires a cumbersome and time-consuming handling in order for it to be repositioned properly within the casing and relative to the relay unit. Even though the push rod is pivotally, but non-removably connected to the retainer or any other portion of the relay unit, an alignment of the outer end of the push rod with the opening in the casing as the relay unit is encased relatively into the casing is not easy to accomplish.

These inconveniences hitherto experienced during the fabrication of the relay assembly might have been successfully eliminated if that portion of the casing, which is aligned in position with the movable contact member, is so designed in any way as to be deformable inwardly of the casing to an extent that that portion of the casing can, when so deformed, drive the movable contact member for testing purpose. This is disclosed in, for example, the Japanese Laid-open Utility Model Publications No. 56-75434 and No. 60-186644, published Jun. 19, 1981, and Dec. 11, 1985, respectively.

According to the publication No. 56-75434, a wall portion of the casing which confronts the movable contact member is formed with a generally U-shaped slit so as to leave a deflectable or pliable tongue which, when deflected by the application of the external pushing force thereto, drives the movable contact member.

A deflectable or pliable tongue similar to that referred to above is also disclosed in the publication No. 60-186644, but the latter discloses a different structure of the relay unit. Specifically, the relay unit disclosed therein has only a pair of contact members which are connected together when the deflectable or pliable tongue are pushed inwardly of the casing. This is possible because of the use of an actuating lever having its opposite ends confronting the tongue and one of the contact members, respectively, a generally intermediate portion of which is pivotally supported by the free end of the yoke. Thus, the external push applied to the tongue can be transmitted to one of the contact member through the actuating lever.

While the design disclosed in any one of the last mentioned two publication is effective to eliminate the inconveniences encountered in the design shown in and described with reference to any one of FIGS. 3 and 4, a different problem has been found in that the interior of the casing is susceptible to a build-up of external dust which intrudes through the slit defining the deflectable or pliable tongue. This means that the electromagnetic relay assembly according to the two Japanese publications is limited in place of installation and may not be used in an environment full of dust and/or a substantial amount of moisture.

In view of the foregoing, the assignee of the present invention is in possession of the Japanese Laid-open Utility Model Publication No. 56-140127, published Oct. 23, 1981, and also, the Japanese Laid-open Utility Model Publication No. 58-7448 which is a division of the publication No. 56-140127 and was published Jan. 18, 1983. According to the Japanese publication No. 56-140127, a corner region of the casing between the top and one side wall thereof has a corner opening defined therein so as to open upwards and transversely and, hence, so as to have a top open area and a side open area. A generally L-shaped covering having top and side wall pieces is normally mounted on the casing to close the corner opening region with the top and side wall pieces closing the top and side open areas, respectively. To permit the casing to receive the L-shaped covering, side edges of the side wall confronting the side open area is formed with guide grooves so as to depict a shape similar to the shape of a figure "U" for receiving mating guide edges formed on three sides of the side wall piece of the L-shaped covering. With the L-shaped covering is in position to close the corner opening in the casing, an outer surface of the side wall piece is formed with a projection which serves concurrently as a knob and an actuating piece.

The L-shaped covering referred to above can also be utilized as a test actuator for the relay unit. In order for the L-shaped covering to be used as the test actuator, the covering then held in position to close the corner opening in the casing should be removed with an external pull applied to the knob. After the covering has been turned 180° about the longitudinal axis of the side wall piece to bring the knob in position to confront the interior of the casing, the covering is then re-mounted on the casing with the side edges guided along the mating guide grooves. As the covering so remounted is seated in the side open area of the corner opening, the knob is, as the actuating piece, brought into engagement with the actuating lever and a further external push applied to the covering causes the actuating piece to urge the actuating lever. In this way, the operability of the electromagnetic relay assembly can be tested.

The Japanese publication No. 58-7448 discloses, in addition to what has been disclosed in the Japanese publication No. 56-140127, another embodiment in which mutually confronting side edges of the wall defining the side open area of the corner opening in the casing are formed with outer and inner sets of parallel guide grooves. While the outer set of the guide grooves are identical in structure and function with the guide grooves disclosed in the publication No. 56-140127, the inner set of the parallel guide grooves are utilized when the covering itself is to be used as the test actuator.

The use of the outer and inner sets of the parallel guide grooves has been intended to avoid the necessity of the covering being turned 180° about the longitudinal axis thereof, such as required in the system of the publication No. 56-140127, when the covering is to be used as the test actuator. Therefore, according to this publication No. 58-7448, when the side wall piece of the covering is inserted guided along the guide grooves of the inner set, a free end of the side wall piece remote from the top wall piece pushes the actuating lever. In this instance, the projection formed on the side wall piece serves solely as the knob.

While the system of any one of the publications No. 56-140127 and No. 58-7448 should prove a substantial improvement over the then existing electromagnetic relay assemblies, to remove the covering and then to insert it again after the testing is indeed felt cumbersome and time-consuming. In addition, as is the case with any of the then existing relay assemblies, the testing of the relay assembly of any one of the publications No. 56-140127 and No. 58-7448 is performed by the application of the external push only along one direction.

SUMMARY OF THE INVENTION

In view of the foregoing, the present invention is a further improvement over the prior art system such as disclosed in any one of the above discussed publications No. 56-140127 and No. 58-7448 and is intended to provide an improved electromagnetic assembly having the test actuator capable of being operated by the application of an external push along one of two directions.

To this end, the present invention provides an electromagnetic relay assembly which comprises a relay unit having a generally elongated contact carrier member supported for pivotal movement about a point of pivot and normally biased in one direction, and a casing enclosing the relay unit and including at least first and second wall members angled relative to each other. The casing has a corner opening defined at a corner region between the first and second wall members and delimited by a first open area of a predetermined shape, defined in the first wall member, and a second open area of generally rectangular shape defined in the second wall member.

The corner opening in the casing is closed by a covering including first and second lids angled relative to each other at an angle equal to the angle delimited between the first and second wall members. When and so long as the covering is mounted on the casing to close the corner opening, the first and second lids cover the first and second open areas, respectively. The second wall member has opposite side edges confronting the side open area, and respective portions of the side edges adjacent the first wall member are formed with guide members for slidably receiving the second lid when the covering is mounted on the casing with said second lid moving in a first direction generally parallel to the second wall member.

An actuating means is secured to the second lid of the covering for driving the contact carrier member in a direction counter to said one direction when an external pushing force is applied to the second lid to allow said second lid to deform and also for driving the contact carrier member in said direction counter to said one direction when said second lid is further slid in said first direction by an application of an external pushing force to said first lid.

BRIEF DESCRIPTION OF THE DRAWINGS

This and other objects and features of the present invention will become readily understood from the following description of a preferred embodiment taken with reference to the accompanying drawings, in which like parts are designated by like reference numerals and in which.

DETAILED DESCRIPTION OF THE EMBODIMENT

Figure 1:
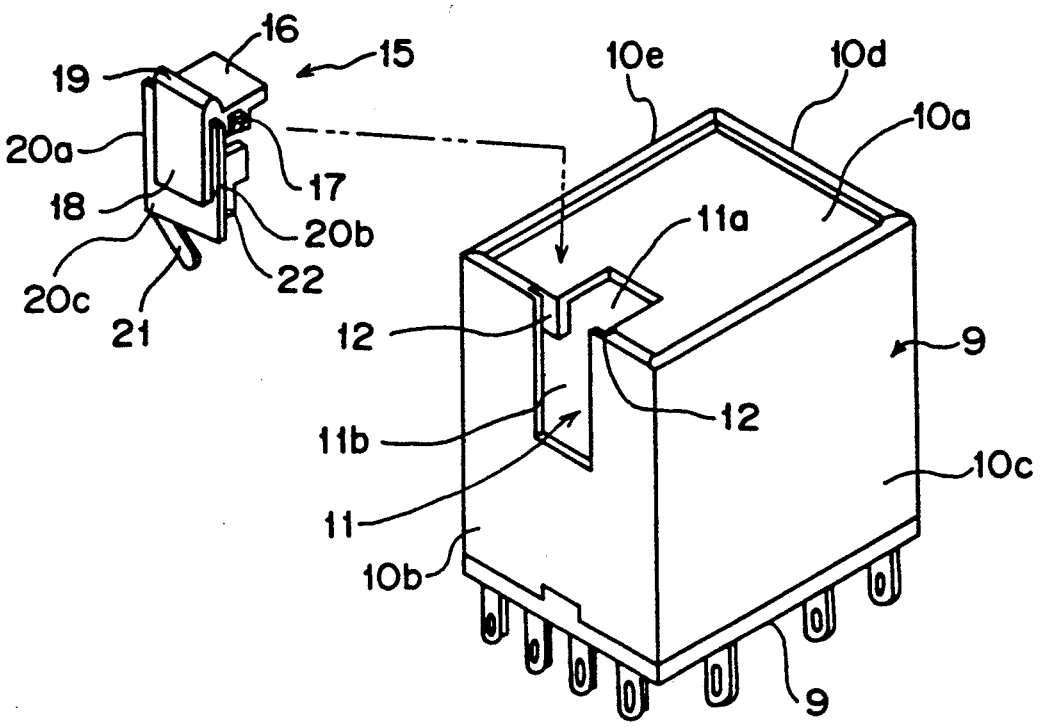
FIG. 1 is a schematic perspective view of an electromagnetic relay assembly embodying the present invention with a covering shown as separated from a casing.
Figure 2:
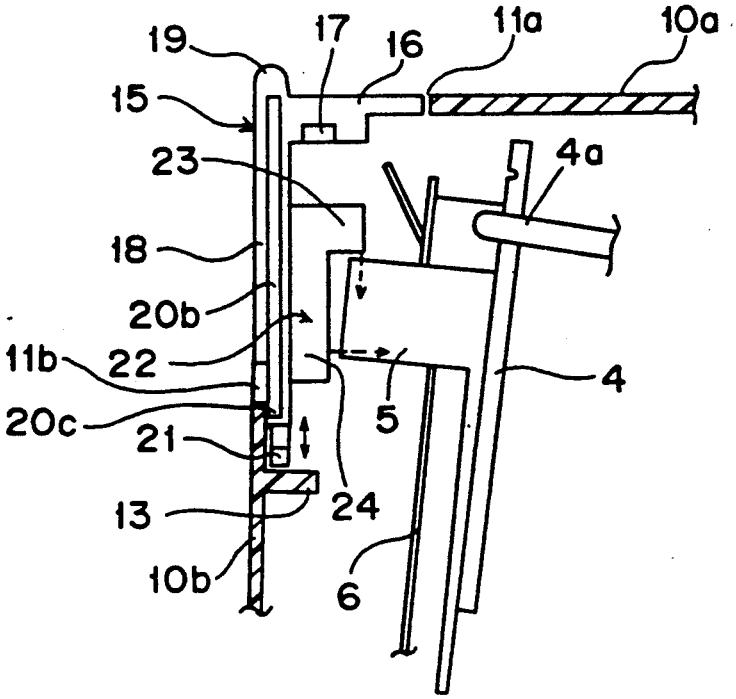
FIG. 2 is a side sectional view, on an enlarged scale, showing the covering in relation to an element to be actuated by the covering according to the present invention.

Referring now to FIGS. 1 and 2, the casing 9 is shown in the form of a generally cubic body including a generally rectangular top wall 10*a* and four side walls 10*b*, 10*c*, 10*d* and 10*e*. The corner opening generally identified by 11 is composed of the top and side open areas 11*a* and 11*b* of generally rectangular configuration and is defined at a corner region between the top wall 10*a* and one of the side walls, for example, the side wall 10*b*. Only respective portions of opposite side edges of the side wall 10*b* confronting the side open area 11*b*, that are adjacent the top wall 10*a* are inwardly recessed at 12 so as to define generally U-sectioned guide grooves in cooperation with one of four side edges of the top wall 10*a* adjacent the side wall 10*b*. The side wall 10*b* has an inner surface formed integrally, or otherwise rigidly, with a bench projection 13 transversely protruding inwardly of the casing and positioned a distance below a bottom edge confronting the side open area 11*b* as best shown in FIG. 2.

The covering, generally identified by 15, that serves concurrently as a part of the test actuator and is designed according to the present invention is of a generally L-shaped configuration including a top lid 16, adapted to cover the top open area 11*a* of the corner opening 11 when the covering is mounted on the casing 9, and a side lid 18 extending perpendicular to the top lid 16 and adapted to cover the side open area 11*b* of the same corner opening 11 when the covering is mounted on the casing 9.

Respective portions of opposite side edges of the top lid 16 adjacent the side lit 18 are formed with elastically deformable engagement pawls 17 protruding laterally away therefrom for engagement from below with associated opposite side edges of the top wall 10*d* confronting the top open area 11*b*, when and so long as the covering 15 is mounted on the casing 9 to close the corner opening 11. Although not essential in the practice of the present invention, a rib 19 is formed at a joint between the top and side lids 16 and 18 so as to extend widthwise thereof and also outwardly so that the rib 19 can form a part of a top trim edge that is defined by respective top edges of the side walls 10*c* to 10*e* while the top wall 10*a* are set a distance inwardly as best shown in FIG. 1.

Three of the surrounding side edges of the side lid 18 except for the side edge thereof continued to the top lid 16 is formed with respective side and bottom flange-like projections 20*a* and 20*b* and 20*c* protruding a distance laterally outwardly from the side lid 18 in a plane parallel thereto. It will therefore readily be understood that, when the covering 15 is to be mounted on the casing 9 to close the corner opening 11, the opposite side projections 20*a* and 20*b* integral with the side lid 18 are inserted into the guide grooves 12 to allow them to slide downwardly, as viewed in FIGS. 1 and 2, guided along the opposite side edges of the side wall 10*b* confronting the side open area 11*b*, until the bottom projection 20*c* integral with the side lid 18 is brought into contact with the bench projection 13.

However, in practice, the bottom projection 20*c* is integrally formed with a pliable finger 21 extending slantwise downwardly therefrom as viewed in FIGS. 1 and 2 and, therefore, when the covering 15 is completely mounted on the casing 9 in the manner described above and so long as no external pushing force is yet applied to the top lid 16, a free end of the pliable finger 21 is brought into engagement with the bench projection 13 as best shown in FIG. 2. In this condition, the corner opening 11 is substantially completely closed by the covering 15 as if the relay assembly embodying the present invention were not the type having the test actuator. At this time, the covering 15 is retained in position to close the corner opening 11 with the engagement pawls 17 engaged from below with the opposite side edges defining the top open area 11*a*.

However, the covering 15 closing the corner opening 11 in the manner described above can be removed if the covering 15 is forcibly pulled upwards allowing the engagement pawls 17 to deform inwardly or to allow at least the top lid 16 itself to be deformed with the engagement pawls 17 retracted inwardly close towards each other.

It is to be noted that, with the covering 15 closing the corner opening 11, there is a margin between the bottom edge of the side lid 18 and the bottom edge defining the bottom of the side open area 11*b* and, however, the top lid 16 will not be held depressed downwardly a distance corresponding to that margin relative to the top wall 10*a* because the resiliency of the pliable finger 12 urges the side lid 16 and, hence, the covering 15 upwardly to permit the top lid 16 to be held generally in flush with the top wall 10*a* of the casing 9.

Figure 3:
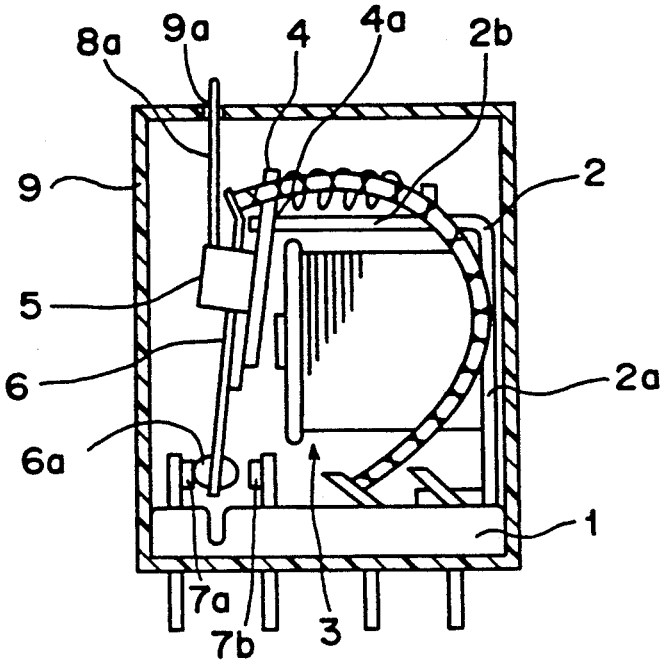
Fig.3 Prior Art
FIG. 3 is a schematic side sectional view of the prior art electromagnetic relay assembly.
Figure 4:
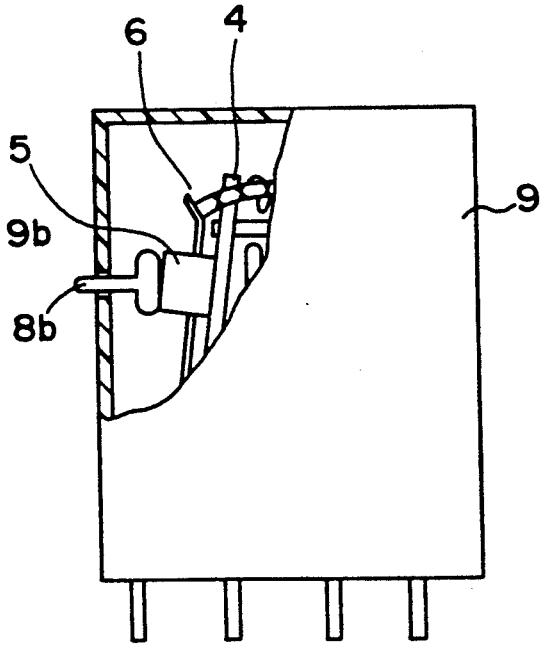
Fig.4 Prior Art
FIG. 4 is a schematic side view, with a portion shown in section, of the other prior art electromagnetic relay assembly.

An actuating piece 22 of generally L-shaped configuration having kick-down and push portions 23 and 24 perpendicular to each other is rigidly secured to, or otherwise integrally formed with, an inner surface of the side lid 18 with the kick-down portion 23 positioned immediately beneath the top lid 16. With the actuating piece 22 so secured to the side lid 18, the kick-down portion 23 extends therefrom towards the movable iron bar 4 that carries the movable contact member 6 through the retainer 5 as hereinbefore described in connection with the prior art shown in FIGS. 3 and 4, and the push portion 24 confronts the retainer 5, as best shown in FIG. 2.

The covering 15 according to the present invention is preferably made of elastic material by the reason which will readily be understood from the subsequent description, no matter what type of material is employed for the top and side walls 10*a* to 10*e*. The actuating piece 22 regardless of whether formed integrally with the covering 15 or whether rigidly secured thereto may have an elasticity, however, the elasticity of the actuating piece 22 should not be of such a value that the actuating piece 22 may be yielded in contact with the retainer 24, by the reason which will also readily be understood from the subsequent description.

The testing of the electromagnetic relay assembly embodying the present invention can be performed in the following manner.

Assuming that the covering 15 is mounted on the casing 9 to close the corner opening 11 as shown in FIG. 2, an application of an external push to the top lid 16 causes the covering 15 as a whole to slide downwards as viewed in FIG. 2 against the resiliency of the pliable finger 21, allowing the kick-down portion 23 to engage the retainer 5. Since the movable iron member 4 carrying the movable contact member 6 through the retainer 5 extends generally parallel to the direction of movement of the kick-down portion 23 while the retainer 5 protrudes into a generally L-shaped space delimited by the kick-down and push portions 23 and 24, the engagement of the kick-down portion 23 with the retainer 5 causes the movable iron member 4 to pivot counterclockwise about the point 4*a* of pivot as viewed in FIG. 2. Thus, as discussed in connection with the prior art shown in FIGS. 3 and 4, the counterclockwise pivot of the movable iron member 4 results in a switching of the contact element 6*a* (FIG. 3) from the fixed contact element 7*a* to the fixed contact element 7*b*.

On the other hand, if the external push is applied to the side lid 18, the side lid 18 itself is deformed inwardly of the casing 9 to allow the push portion 24 to protrude and, hence, the retainer 5 is pushed in a right-hand direction, as viewed in FIG. 2, causing the movable iron member 4 to pivot about the point 4*a* of pivot in the manner similar to that occurring when the external push is applied to the top lid 16. The covering 15 will not collapse into the casing 9 because the opposite side projections 20*a* and 20*b* integral with the side lid 18 are partially retained in and within the guide grooves 12.

Thus, it has now become clear that the electromagnetic relay assembled easier than the prior art relay assembly and that it does not require the covering to be removed and, after having been turned, inserted in readiness for the testing of the relay assembly.

Although the present invention has fully been described in connection with the preferred embodiment thereof with reference to the accompanying drawings, it is to be noted that various changes and modifications are apparent to those skilled in the art without departing from the scope thereof as defined by the appended claims. For example, the present invention can be equally applied to the relay assembly of the type having the actuating lever as discussed in connection with the prior art. Also, the rib 19 may not be essential in the practice of the present invention.

Also, although the opening adapted to be covered by the covering has been described and shown as formed at the corner region between the top and one of the side walls, it may be defined at a corner region between two of the side walls depending on the position of the relay unit within th casing. Again, although the casing has been shown and described as formed of the generally cubic body, it may be of a generally cylindrical shape comprising a top wall and a cylindrical side wall.

Furthermore, although reference has been made to the use of the movable iron member and the movable contact member separate therefrom, the movable iron member may be dispensed with to allow the movable contact member to take the place of it. In such case, the movable contact member should be supported in a manner similar to the illustrated support of the movable iron member by the yoke and, in place of the retainer, an engagement boss may suffice for the engagement with the actuating piece.

Yet, although the covering has been described as preferably made of elastic material, rigid and elastic material may be employed for the top and side lids, respectively. For example, the top wall may be made of metal and the side lid may be made of an elastic synthetic resin. In addition, the top lid may have any other shape different from the generally rectangular shape of the side lid and, in such case, the top open area of the corner opening should have a shape similar to the shape of the top lid.

Yet, if the bottom flange-like projection is made to have a thin wall thickness and has, therefore, a sufficient resiliency, the elastic finger may be dispensed with.

Accordingly, such changes and modifications are to be understood as included within the scope of the present invention.

What is claimed is:

1. An electromagnetic relay assembly which comprises:

a relay unit having a generally elongated contact carrier member supported for pivotal movement about a point of pivot and normally biased in one direction;

a casing enclosing the relay unit and including at least first and second wall members angled relative to each other, said casing having a corner opening defined at a corner region between the first and second wall members, said corner opening being delimited by a first open area of defined in the first wall member and a second open area defined in the second wall member;

a covering adapted to close the corner opening in the casing and including first and second lids angled relative to each other at an angle equal to the angle delimited between the first and second wall members, said first and second lids covering the first and second open areas, respectively, when the covering is mounted on the casing to close the corner opening, at least said second lid being deformable;

either of said first and second wall members having guide members for slidably receiving the second lid in a first direction generally parallel to the second wall member; and actuating means secured to the second lid of the covering for driving the contact carrier member in a direction counter to said one direction when an external pushing force is applied to the second lid to deform said second lid and also for driving the contact carrier member in said direction counter to said one direction when an application of an external pushing force is applied to said first lid.

2. The electromagnetic relay assembly as claimed in claim 1, wherein said casing is of a generally cubic configuration including a top wall and four side walls each being perpendicular to the top wall and said relay unit includes a base concurrently serving as a bottom wall for the casing, and wherein said first wall member is the top wall of the casing and said second wall members are the four side walls of the casing.

3. The electromagnetic relay assembly as claimed in claim 2, wherein each of said guide members is a groove for slidably receiving a corresponding portion of the associated side edge of the second lid adjacent the top wall of the casing.

4. The electromagnetic relay assembly as claimed in claim 2, further means for applying a biasing force to the covering thereby to allow the covering to return to an original position once the covering is driven by the application of the external pushing force to said second lid.

* * * * *